United States Patent [19]

Kelso et al.

[11] 4,176,684

[45] Dec. 4, 1979

[54] SPLASH DOWN

[76] Inventors: Richard C. Kelso; Eileen E. Kelso, both of 588 Summerdale Ave., Glen Ellyn, Ill. 60137

[21] Appl. No.: 845,486

[22] Filed: Oct. 26, 1977

[51] Int. Cl.[2] ..... E03C 1/00

[52] U.S. Cl. ..... 137/562; 137/801; 285/8; 285/9 M

[58] Field of Search ..... 137/562, 801; 141/DIG. 1; 285/8, 9 M, 298, 303

[56] References Cited

U.S. PATENT DOCUMENTS

| | | | |
|---|---|---|---|
| Re. 28,294 | 1/1975 | Hansel | 285/9 M X |
| 1,020,207 | 3/1912 | Kells | 137/801 X |
| 1,043,440 | 11/1912 | Kells | 137/801 X |
| 1,080,562 | 12/1913 | Kells | 137/801 X |
| 1,189,052 | 6/1916 | Brookshire | 285/303 |
| 1,527,135 | 2/1925 | Hepburn et al. | 137/562 X |
| 1,597,635 | 8/1926 | Stickdorn | 285/8 X |
| 1,723,765 | 8/1929 | Churchill | 137/562 X |
| 1,826,829 | 10/1931 | Scott | 137/562 X |
| 3,967,643 | 7/1976 | Lutringer | 137/801 X |

*Primary Examiner*—Gerald A. Michalsky
*Attorney, Agent, or Firm*—Richard M. McMahon

[57] ABSTRACT

This invention relates generally to fluid discharge devices and, more particularly, to a discharge device for use with a combined filling and draining faucet attachment commonly used with portable washing machines and portable dishwashers. The invention relates specifically to a fluid discharge device having a round hollow truncated cover shaped body with a tubular structure at the top, an adjustment tube inserted into the tubular structure of the body and extending upward allowing for height adjustment of the device. The vertical discharge outlet of the faucet attachment is inserted into the top of the adjustment tube and the height of the discharge device is adjusted so that the base of the device rests on the bottom of the sink and encircles the sink drain.

2 Claims, 4 Drawing Figures

SPLASH DOWN

SUMMARY OF THE INVENTION

This invention relates generally to fluid handling devices, and more particularly to an improved splashdown discharge device for use with a combined filling and discharge faucet attachment as commonly used with portable washing machines, dishwashers, and similar appliances. Such filling and discharge devices are usually supported from a faucet about the sink and have a means connecting it to the machine for filling the machine with water. One difficulty encountered with the use of such conventional filling and draining attachments with portable washing machines or dishwashers in the manner described above is that the discharge fluid from the discharge nozzle splashes as it strikes the sink. This occurs because the rate of discharge flow from the machine is moderately high in order to drain the machine within a reasonable time period.

Various devices have been proposed heretofore to reduce or minimize splashing such as screen-like aerators or baffle devices to reduce the energy level of the discharge fluid before it leaves the discharge nozzle. Such devices are subject to clogging due to the contaminate particles carried by the discharge fluid.

Other devices have been proposed which reduce to a degree the energy level of the discharge fluids through deflection in various chambers. However, such devices are expensive and are not fully effective in elimination of all splash as the discharge fluid still leaves the discharge nozzle into an open sink. The present invention is directed towards elimination of splash without the secondary problems of an expensive device or clogging.

The present invention has an object to provide a splashdown compatible with the discharge nozzle of conventional portable washing machines and dishwashers. Another object of this invention is to provide a discharge splash elimination device which is durable, attractive, yet inexpensive.

A further object of this invention is to provide a splashdown which is non-clogging, and which can be adaptable to any discharge nozzle used with said portable machines. Another object is to provide a splashdown which is capable of easy storage when not in use.

Another object of the present invention is to provide an inexpensive splashdown which can be made in attractive decorative colors compatible with kitchen appliance colors.

A further object of the invention is to maximize operability of the device by providing a means of holding the splashdown firmly to the sink while in use. Still another object of this invention is to provide a splashdown which is adjustable in height to conventional sink heights for use in the manner described.

This invention possesses other objects and features of advantage which will become apparent from the following description taken in conjunction with the accompanying drawings.

DETAILED DESCRIPTION

Figure 1:
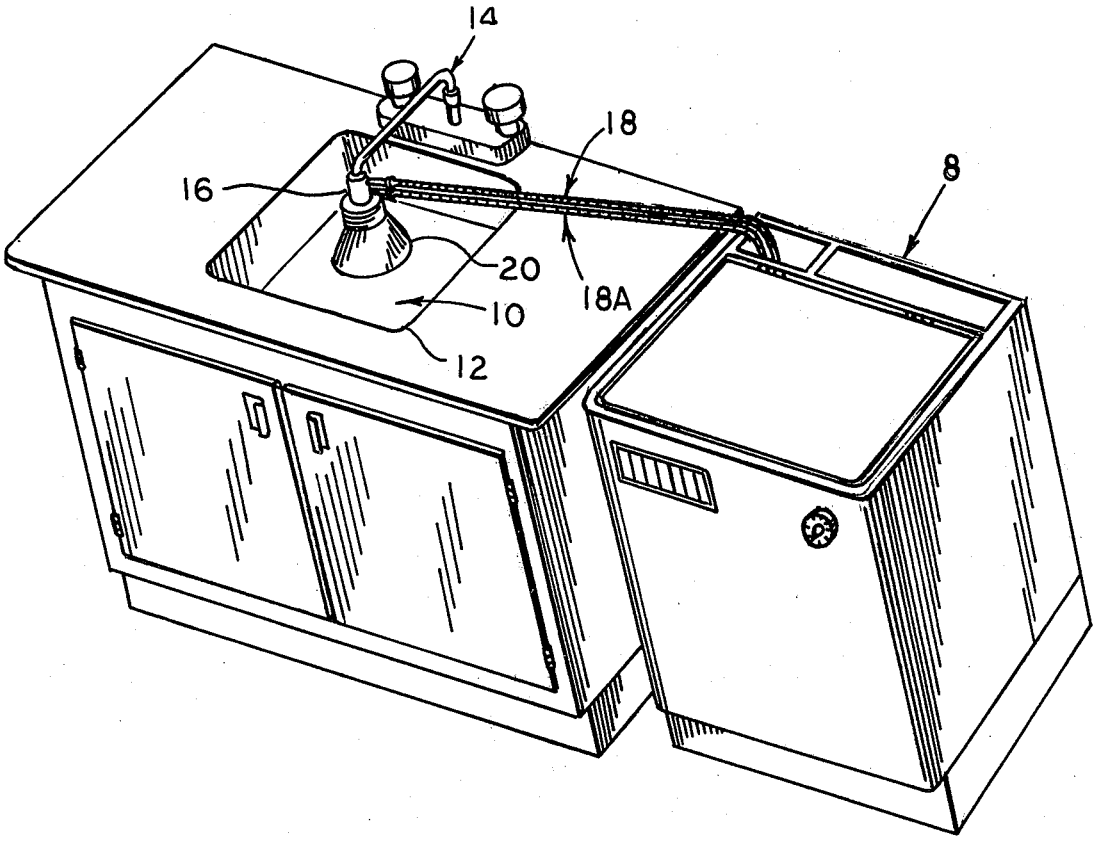
FIG. 1 is a perspective view of the splashdown device constructed in accordance with this invention arranged in a sink associated with a conventional filling and draining faucet connected to an appliance.

Referring to the drawings for a better understanding of the present invention, as shown in FIG. 1, the splashdown 20, is depicted connected to a conventional filling and discharge faucet attachment 16 of a conventional sink 10. Intake hose 18 and discharge hose 18A extend from the faucet attachment 16 to the washing appliance 8. The faucet attachment 16 is attached to a conventional faucet 14 to provide water through intake hose 18 to the appliance 8. Splashdown 20 is fitted over and encompasses the sink drain 12. Discharge fluid from the appliance flows through discharge hose 18A to the faucet attachment 16 and through the splashdown 20 directly into the sink drain 12.

Figure 2:
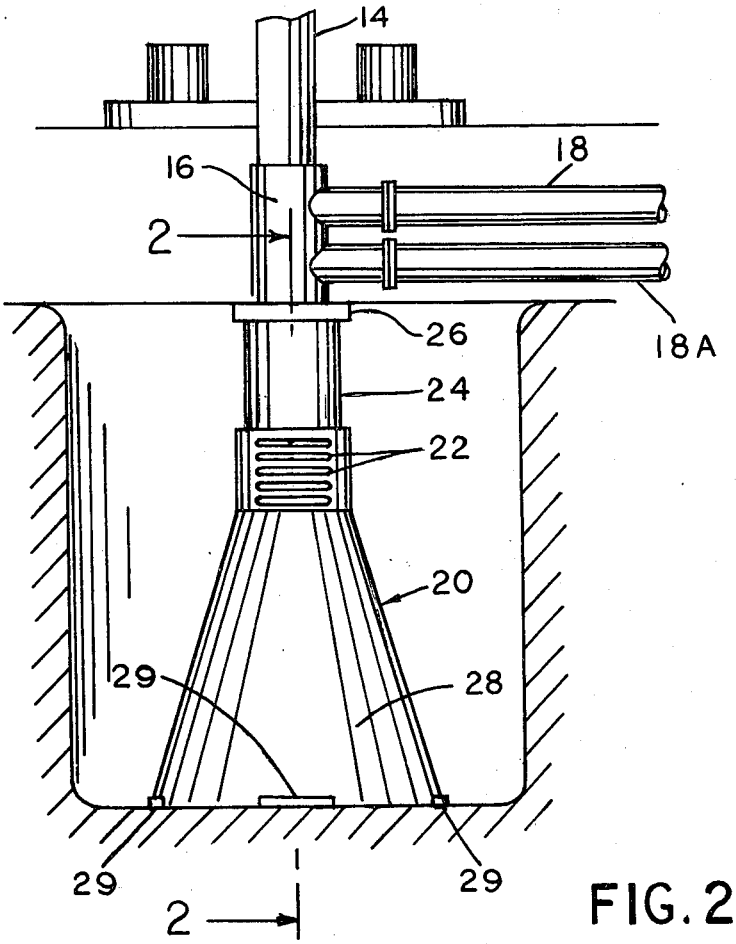
FIG. 2 is a side elevational view, partly cut away, showing a splashdown device constructed in accordance with this invention.
Figure 3:
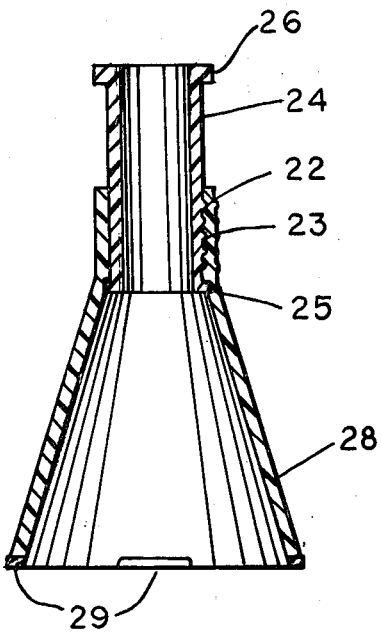
FIG. 3 is a cross sectional side view of the splashdown device taken along the line 2—2 shown in FIG. 2.
Figure 4:
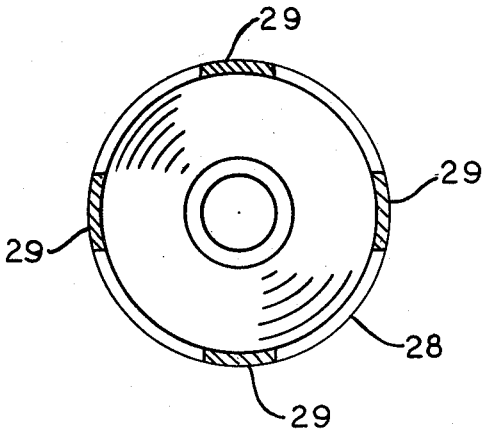
FIG. 4 is a bottom plan view showing the position of the embedded magnets in the base of the splashdown device.

As shown in FIGS. 2 and 3, splashdown 20 has a round hollow truncated cone-shaped body with tubular structure at the top of truncated cone 28. In use, the body 28 rests on the bottom of the sink 10 and encircles the sink drain 12. Splashdown 20 is held to the bottom of sink 10 and over sink drain 12 by magnetic attraction of magnets 29 embedded in the base of 28 to the sink 10 and sink drain 12.

As shown in FIG. 2, adjustment tube 24 may be extended or lowered into splashdown body 28. Top shoulder rim 26 is of a larger diameter than the inside diameter of top of the body 28 and extends around adjustment tube 24 at the top. Discharge nozzle of the filling and draining faucet attachment 16 is inserted into adjustment tube 24. Top shoulder rim 26 prevents the adjustment tube 24 from dropping into the splashdown body 28. A similar bottom shoulder rim 25 is located at the bottom of adjustment tube 24 and is of a larger diameter than the inside diameter of top of the body 28. Bottom shoulder 25 extends around adjustment tube 24 and prevents the adjustment tube 24 from being pulled out of the splashdown body 28.

Referring to FIG. 3, the height of splashdown 20 may be adjusted by extending or lowering adjustment tube 24 into body 28 to adjust the height of the device to the height requirements of conventional sinks. Adjustment tube 24 has a series of male shoulder graduations 23 slightly larger than the outside diameter of adjustment tube 24 but less than the diameter of top shoulder rim 26 or bottom shoulder rim 25. This series of male shoulder graduations 23 extend around the outside diameter of adjustment tube 24 at the bottom portion of this adjustment tube. Splashdown body 28 has a similar series of female indentation graduations 22 around the inside diameter at the top of the tubular portion of the body. The spacing between successive shoulder graduations 23 on adjustment tube 24 and shoulder indentation graduations on splashdown body 28 are the same. The male shoulder graduation 23 on the adjustment tube 24 engage and are held by the matching series of female indentation graduations 22 on body 28 which allows for height adjustment as described above.

Typical but not restrictive dimensions of the splashdown 20 when adjustment tube 24 is fully extended is 9½ inches high from top to bottom and 7½ inches in height when not extended. In practice, these dimensions are easily modified for use of the splashdown with deeper or more shallow sinks. The splashdown is collapsed for easy storage when not in use.

Splashdown 20 may be constructed from a suitable durable but flexible material such as polyvinylchloride, polyethylene, synthetic rubber or like materials. The splashdown is constructed with colored material made with decorative colors to match typical kitchen appliance colors. The thickness of the splashdown body 28 and adjustment tube 24 may be varied but must be of sufficient gauge or thickness to stand firm and rigid on the bottom of the sink.

The round hollow conical shaped body 28 of the splashdown device is of a larger diameter than the discharge nozzle of faucet attachment 16, thus permitting the discharge fluid to flow unimpeded and without clogging. All splashing is eliminated as the discharge fluid is contained within the invention which completely encircles the drain.

Because other variations, changes, and modifications may be made to the embodiments described, it is intended that all matter in the foregoing description be interpreted as illustrative and not as limitations of my invention or the scope of the appended claims.

What I claim as new and desire to secure by Letters of patent of the United States is:

1. In combination, a filling and draining attachment joined to a water using appliance, a water faucet spaced above a sink equipped with a lower drain, said attachment connected to the faucet includes a downward vertical discharge outlet, a fluid discharge device comprising:

a round hollow truncated cone-shaped body with a tubular structure at the top of the truncated cone, a movable adjustment tube inserted into the tubular structure portion of the body and extends upward from the body of the device, said adjustment tube having a series of male shoulder graduations extending around the outside diameter and held by a matching series of female indentations extending around the inside diameter of the tubular structure portion of the body, said vertical discharge outlet of the faucet attachment is inserted into the top of the adjustment tube and the height of the fluid discharge device is adjusted so that the base of the device rests on the bottom of the sink and encircles the sink drain, said base of fluid discharge device having magnets embedded into the base of the round truncated cone shaped body to hold the device in use to the bottom of the sink.

2. A fluid discharge device as claimed in claim 1, wherein the device is constructed of a durable but flexible material colored to match typical appliance colors with decorative colors.

* * * * *